US007952284B2

(12) United States Patent
Van Eysendyk et al.

(10) Patent No.: US 7,952,284 B2
(45) Date of Patent: May 31, 2011

(54) HIGH-PRESSURE DISCHARGE LAMP

(75) Inventors: Tim Van Eysendyk, Turnhout (BE); Jan Margareta Peeraer, Turnhout (BE)

(73) Assignee: Koninklijke Philips Electronics N.V., Eindhoven (NL)

( * ) Notice: Subject to any disclaimer, the term of this patent is extended or adjusted under 35 U.S.C. 154(b) by 389 days.

(21) Appl. No.: 11/814,013

(22) PCT Filed: Jan. 16, 2006

(86) PCT No.: PCT/IB2006/050145

§ 371 (c)(1), (2), (4) Date: Jul. 16, 2007

(87) PCT Pub. No.: WO2006/077516

PCT Pub. Date: Jul. 27, 2006

(65) Prior Publication Data

US 2008/0116806 A1 May 22, 2008

(30) Foreign Application Priority Data

Jan. 19, 2005 (EP) ..... 05100304

(51) Int. Cl.
*H01J 17/04* (2006.01)
*H01J 61/04* (2006.01)

(52) U.S. Cl. ..... 313/633; 313/623; 313/624; 313/625; 313/634; 313/637; 313/638; 313/318.12

(58) Field of Classification Search ..... 313/623–625, 313/634–643, 493, 318.12, 570, 633
See application file for complete search history.

(56) References Cited

U.S. PATENT DOCUMENTS

| | | | | |
|---|---|---|---|---|
| 5,424,609 | A * | 6/1995 | Geven et al. | 313/623 |
| 6,027,389 | A | 2/2000 | Muyazawa et al. | |
| 2001/0043045 | A1 * | 11/2001 | Wijenberg et al. | 313/623 |
| 2005/0082983 | A1 * | 4/2005 | Anton Apetz et al. | 313/623 |

FOREIGN PATENT DOCUMENTS

| | | | |
|---|---|---|---|
| EP | 0587238 | A1 | 9/1992 |
| EP | 0722183 | A2 | 7/1996 |
| EP | 0887838 | A2 | 1/1998 |
| EP | 926703 | A2 | 6/1999 |
| EP | 1056116 | A2 | 11/2000 |
| EP | 1193734 | A1 | 4/2002 |
| EP | 1351278 | A2 | 10/2003 |
| EP | 0472100 | A2 | 1/2008 |
| GB | 639797 | | 7/1950 |

* cited by examiner

*Primary Examiner* — Nimeshkumar D Patel
*Assistant Examiner* — Thomas A Hollweg

(57) ABSTRACT

A metal halide lamp with a more stable lamp voltage, comprising a ceramic discharge vessel which encloses a discharge space, in which a first and a second electrode are arranged, which discharge vessel has a central zone extending between the electrodes and being closed at either side by a first and a second end zone, respectively, in which the first end zone surrounds, with little clearance, a current supply conductor connected to the first electrode and extending to the exterior through a seal to the wall of the first end zone, which current supply conductor has a halide-resistant section facing the discharge space and a section remote from the discharge space, wherein the halide-resistant section of the first current supply conductor comprises a wire made of tungsten or of tungsten alloyed with molybdenum.

4 Claims, 2 Drawing Sheets

HIGH-PRESSURE DISCHARGE LAMP

Figure 1:
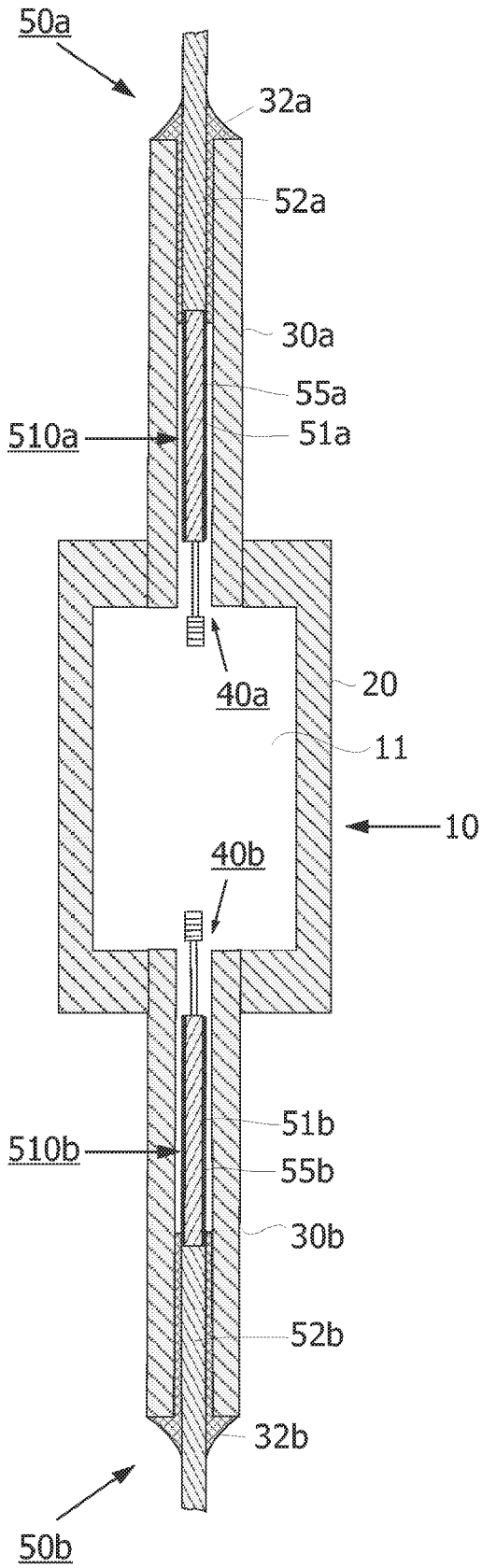

The invention relates to a metal halide lamp comprising a ceramic discharge vessel which encloses a discharge space, in which a first and a second electrode are arranged, which discharge vessel has a central zone extending between the electrodes and being closed at either side by a first and a second end zone, respectively, in which the first end zone surrounds, with little clearance, a current supply conductor connected to the first electrode and extending to the exterior through a seal to the wall of the first end zone, which current supply conductor has a halide-resistant section facing the discharge space and a section remote from the discharge space. The ceramic discharge vessel is generally filled with an ionizable filling comprising a metal halide.

The term "ceramic discharge vessel" in the present description and claims is understood to mean a discharge vessel of a refractory material such as monocrystalline metal oxide, for example, sapphire, polycrystalline metal oxide, for example, translucent gastight aluminum oxide (DGA), yttrium-aluminum garnet (YAG) or yttrium oxide (YOX), or polycrystalline non-oxidic material such as aluminum nitride (AIN). The term "halide-resistant" means that no or substantially no corrosive attack by halides and free halogens takes place under the conditions prevailing in the discharge space during lamp operation. The term "little clearance" means that the space remaining between the end zone and the current supply conductor issuing through it is at least 3 μm and at most one fourth of the internal diameter of the end zone, but not more than approximately 200 μm.

A lamp of the type mentioned in the opening paragraph is disclosed in EP 0 587 238. In the known lamp, a metal rod forming a current supply conductor is passed through each end zone of the discharge vessel. The space remaining between the section of the current supply conductor remote from the discharge space and the end zone is filled with a ceramic sealing compound. Niobium or tantalum are generally used as the material for the section of the current supply conductor remote from the discharge space because these metals have coefficients of expansion, which, averaged across the temperature range experienced by the end zone during the life of the lamp, closely match those of the ceramic materials from which the discharge vessel is manufactured.

Since said metals are not halide-resistant, the section facing the discharge space is therefore at least provided with a cover of halide-resistant material such as metals from the group formed by tungsten, molybdenum, platinum, iridium, rhenium and rhodium, and/or an electrically conducting silicide, carbide or nitride of at least one of these metals, for example, molybdenum disilicide. A frequently used alternative construction of a halide-resistant section is the one in which the halide-resistant section of the current supply conductor comprises a molybdenum coil, coiled around a molybdenum rod, or molybdenum-cermet.

The known metal halide lamp has the drawback that the lamp voltage gradually increases during the lifetime of the lamp, which shortens the lifetime and will finally lead to failure of the lamp.

It is an object of the present invention to provide a metal halide lamp of the type described in the opening paragraph in which said drawback is counteracted.

To this end, the lamp according to the invention is characterized in that the halide-resistant section of the first current supply conductor comprises a wire made of tungsten or of molybdenum alloyed with tungsten. The inventors have found that a lamp in which the halide-resistant section of the first current supply conductor comprises a wire made of tungsten or of molybdenum alloyed with tungsten has a more stable lamp voltage during its lifetime.

A preferred embodiment of the high-pressure discharge lamp according to the invention is characterized in that the halide-resistant section of the second current supply conductor also comprises a wire of tungsten or molybdenum alloyed with tungsten.

In the lamp of the invention, the current supply conductor connected to the first electrode extends to the exterior through a seal to the wall of the first end zone. The section of the current supply conductor remote from the discharge space generally consists of niobium or tantalum. In a preferred embodiment, the seal covers this section completely, and extends partly across the halide-resistant section of the current supply conductor. The seal that covers the section of the current supply conductor remote from the discharge space, as well as a part of the halide-resistant section not only improves the service life of the lamp, but also decreases warping of the current supply conductor. Said warping may cause early failure of the lamp. The seal may comprise e.g. a ceramic sealing compound known in the art.

A preferred embodiment of the high-pressure discharge lamp according to the invention is characterized in that the wire of the halide-resistant section forms a mandrel, which is further surrounded by a winding of a wire which comprises at least one of the metals tungsten, molybdenum, platinum, iridium, rhenium and rhodium. This embodiment has the advantage that the space left open in the end zone can be small without leading to thermal stresses. A small open space between the end zone and the respective current supply conductor has the advantage that it can hold few fill ingredients. This improves the reproducibility of the lamp behavior.

The winding is preferably manufactured from a wire having a diameter of between one fourth and half the diameter of the mandrel of the halide-resistant section surrounded thereby. On the one hand, the wire diameter is then large enough to readily avoid fracturing of the wire during its manufacture, and, on the other hand, small enough for easy handling, in particular for coiling it around the mandrel of the halide-resistant section.

The wire of the halide-resistant section forming the mandrel of at least the first current supply conductor may be alloyed with tungsten. It was found that molybdenum alloyed with at most 50% by weight of tungsten has a thermal coefficient of expansion that can easily be matched closely to the thermal coefficient of expansion of the seal so as to avoid early fractures while cooling the seal during the process of manufacturing the lamp. However, the molybdenum is preferably alloyed with at least 10% by weight of tungsten. At weight percentages of more than 10% of tungsten, the most stable lamp voltages were observed.

Figure 2:
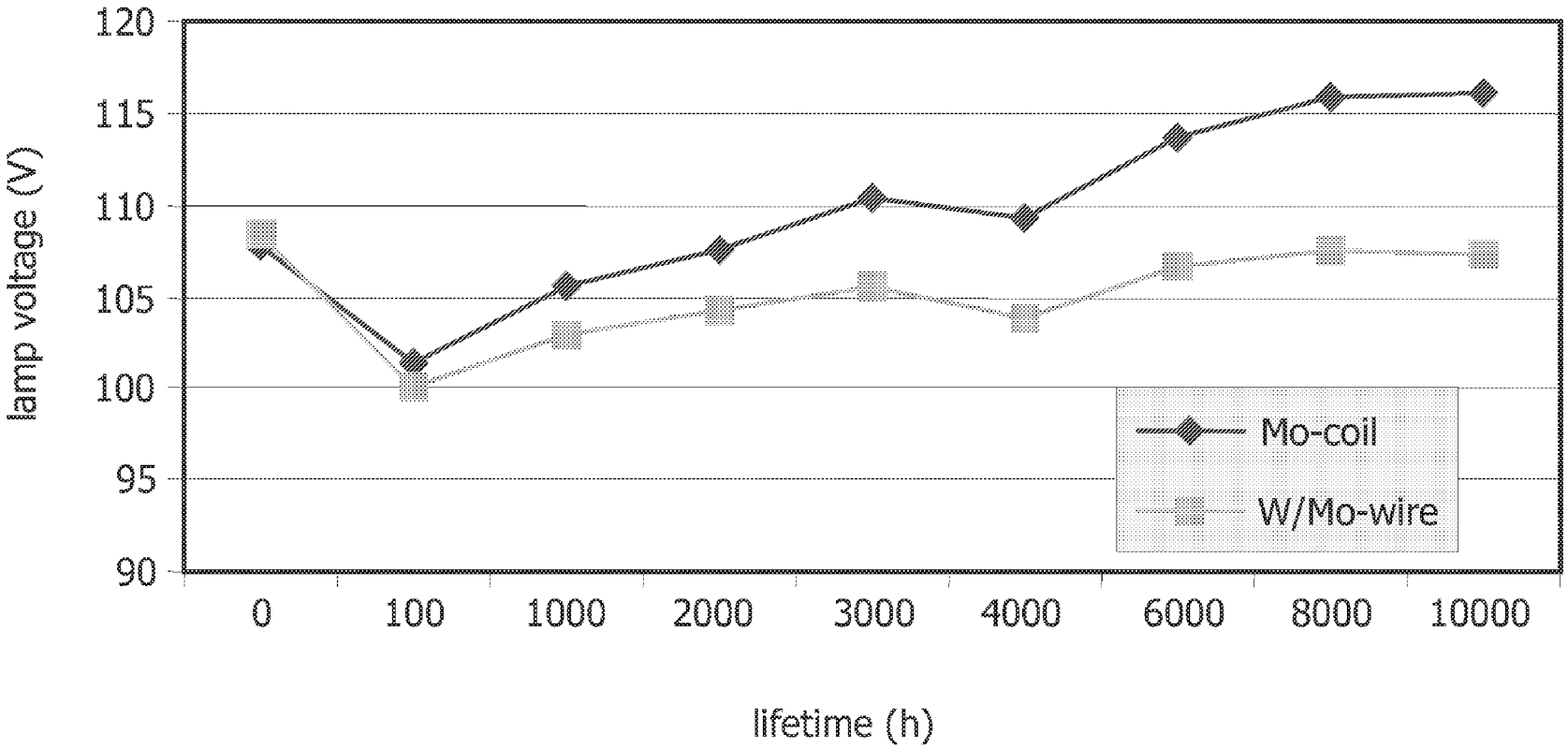

These and other aspects of the metal halide lamp according to the invention will be explained in more detail with reference to the drawings, in which FIG. 1 shows an embodiment of a lamp according to the invention in a longitudinal section, and FIG. 2 shows the lamp voltage as a function of the lifetime of a lamp with a known Mo-coiled Mo-wire and a lamp according to the invention, denoted by "W/Mo-wire".

The high-pressure discharge lamp shown in FIG. 1 is a metal halide lamp comprising a ceramic discharge vessel 10 which encloses a discharge space 11, in which a first electrode 40*a* and a second electrode 40*b* are arranged, which discharge vessel has a central zone 20 extending between the electrodes and being closed at either side by a first end zone 30*a* and a second end zone 30*b*, respectively, in which the first end zone surrounds, with little clearance, a current supply conductor

50*a* connected to the first electrode and extending to the exterior through a seal 32*a* to the first end zone, which current supply conductor has a halide-resistant section 510*a* facing the discharge space and a section 52*a* remote from the discharge space. The halide-resistant section 510*a* of the first current supply conductor comprises a wire 51*a* made of tungsten or of molybdenum alloyed with tungsten. The discharge vessel 10 is made of DGA material which encloses a discharge space 11 and is provided with an ionizable filling comprising metal halides. A practical embodiment of the shown lamp has a power consumption of 70 W (or 150 W, for which numbers are given in brackets) during nominal operation.

In this embodiment, the filling comprises 5 (15) mg of mercury and 8 (13 mg) mg of the metal halides sodium iodide, thallium iodide and dysprosium iodide in a weight ratio of 69:8:8. The filling also comprises argon and a starting gas. Each electrode 40*a*, 40*b* is formed by a tungsten rod with a length of 3 mm (6 mm) and a diameter of 300 (500) μm, while having a single winding of tungsten wire of 170 (160) μm diameter at a free end over a distance of 1200 (1500) μm. The first and the second cylindrical end zone 30*a*, 30*b* connected to the central zone 20 each surround a current supply conductor 50*a*, 50*b* with little clearance, which current supply conductors are connected to the respective electrodes 40*a*, 40*b*, and with respective seals 32*a*, 32*b* of a ceramic sealing compound to each end zone, through which seals the relevant current supply conductor 50*a*, 50*b* issues to the exterior. The central zone 20 has an internal length of 7 (13) mm, an external diameter of 7.6 (11.4) mm and a wall thickness of 0.8 mm. The end zones 30*a*, 30*b* have an external diameter which is small in relation to that of the central zone 10. The end zones have an external diameter of 2.6 (2.6) mm. The end zones 30*a*, 30*b* have an internal diameter of approximately 0.76 (0.975) mm. Each current supply conductor 50*a*, 50*b* comprises a halide-resistant section 510*a*, 510*b* facing the discharge space 11 of 0.70 mm diameter, and a second section 52*a*, 52*b* remote from the discharge space and formed by a 0.72 mm thick rod of niobium. Each halide-resistant section 510*a*, 510*b* of the current supply conductors consists of a molybdenum mandrel 51*a*, 51*b* comprising 20% by weight of tungsten, which mandrels are further surrounded by windings 55*a*, 55*b* made from a molybdenum wire. The wires forming the mandrels 51*a*, 51*b* have a diameter of 386 (448) μm and the windings 55*a*, 55*b* are made from wire with a diameter of 139 (161) μm. Thus, the winding wires have a diameter of between one fourth and half the diameter of the mandrel of the halide-resistant section surrounded thereby. Accordingly, the average clearance between the end zone 30*a*, 30*b* and the halide-resistant section 510*a*, 510*b* passed through it is approximately 0.05 (0.1) mm. The ceramic sealing compound covers the niobium rod sections 52*a*, 52*b* inside the end zones completely, and extends partly across the halide-resistant sections 510*a*, 510*b* facing the discharge space.

The invention will be further elucidated by way of the following examples.

EXAMPLE 1

A 150 W lamp according to the invention as shown in FIG. 1 was subjected to a 10,000-hour endurance test. The lamp voltage is shown in FIG. 2 by the line denoted by "W/Mo-wire". A comparative experiment was carried out with a known 150 W lamp comprising a molybdenum wire with a molybdenum coil ("Mo-coil"). The lamp voltage in the lamp according to the invention turned out to be more stable than the lamp voltage of the existing 150 W lamp.

EXAMPLE 2

The embodiment of the 70 W lamp according to FIG. 1 was compared with a known 70 W lamp comprising a molybdenum wire with a molybdenum coil in an accelerated test applying an overvoltage. The electrodes of the known lamp exhibits warping after 1000 hours, while the electrodes in the lamp according to the invention were still straight, exhibiting no warping.

The invention claimed is:

1. A metal halide lamp comprising a ceramic discharge vessel which encloses a discharge space, first and second electrodes arranged in the discharge space, wherein the ceramic discharge vessel has a central zone extending between the electrodes and being closed at either side by a first and a second end zone, respectively, a first current supply conductor surrounded by the first end zone with clearance equal to or less than 0.3 mm, wherein the first current supply conductor is connected to the first electrode and extends to the exterior through a seal to the wall of the first end zone, the first current supply conductor comprising a halide-resistant section facing the discharge space and a section adjacent to the halide-resistant section and remote from the discharge space, wherein the section adjacent to the halide-resistant section and remote from the discharge space is completely encompassed by the seal and is not exposed to the discharge space through the first end zone clearance, the halide-resistant section of the first current supply conductor comprising a wire made of molybdenum alloyed with from 10 to 20% by weight of tungsten.

2. A metal halide lamp according to claim 1, wherein the wire of the halide-resistant section forms a mandrel, which is further surrounded by a winding of a second wire comprising one or more of the metals tungsten, molybdenum, platinum, iridium, rhenium, and rhodium.

3. A metal halide lamp according to claim 1, wherein the seal covers the section of the first current supply conductor remote from the discharge space and extends partly across the halide-resistant section.

4. A metal halide lamp according to claim 1, further comprising a second current supply conductor surrounded by the second end zone with clearance equal to or less than 0.3 mm, wherein the second current supply conductor is connected to the second electrode and extends to the exterior through a seal to the wall of the second end zone, the second current supply conductor comprising a halide-resistant section facing the discharge space and a section adjacent to the halide-resistant section and remote from the discharge space, wherein the section adjacent to the halide-resistant section and remote from the discharge space is completely encompassed by the seal and is not exposed to the discharge space through the first end zone clearance, the halide-resistant section of the second current supply conductor comprising a wire made of molybdenum alloyed with tungsten.

* * * * *